US007748812B2

(12) United States Patent
Oshima

(10) Patent No.: US 7,748,812 B2
(45) Date of Patent: Jul. 6, 2010

(54) LIQUID JET APPARATUS AND DRIVING METHOD FOR LIQUID JET APPARATUS

(75) Inventor: Atsushi Oshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 49 days.

(21) Appl. No.: 12/340,940

(22) Filed: Dec. 22, 2008

(65) Prior Publication Data

US 2009/0174738 A1 Jul. 9, 2009

(30) Foreign Application Priority Data

Dec. 27, 2007 (JP) ..... 2007-337472

(51) Int. Cl.
*B41J 29/38* (2006.01)

(52) U.S. Cl. ..... 347/11; 347/10

(58) Field of Classification Search ..... None
See application file for complete search history.

(56) References Cited

U.S. PATENT DOCUMENTS

| | | | | |
|---|---|---|---|---|
| 7,571,989 | B2 * | 8/2009 | Ishizaki | 347/57 |
| 7,581,802 | B2 * | 9/2009 | Tabata et al. | 347/14 |
| 7,585,037 | B2 * | 9/2009 | Tabata et al. | 347/10 |

FOREIGN PATENT DOCUMENTS

| | | |
|---|---|---|
| JP | 2000-245162 | 9/2000 |
| JP | 2003-237068 | 8/2003 |
| JP | 2005-329710 | 12/2005 |
| JP | 2006-231882 | 9/2006 |
| JP | 2006-256151 | 9/2006 |
| JP | 2007-096364 | 4/2007 |
| JP | 2007-168172 | 7/2007 |
| JP | 2007-190708 | 8/2007 |
| JP | 2008-049698 | 3/2008 |
| JP | 2008-087467 | 4/2008 |

* cited by examiner

*Primary Examiner*—Omar Rojas
(74) *Attorney, Agent, or Firm*—Workman Nydegger

(57) ABSTRACT

A liquid jet apparatus according to the present invention includes a drive waveform generator adapted to generate a drive waveform signal, a modulator adapted to execute pulse modulation on the drive waveform signal, a digital power amplifier adapted to power-amplify the modulated signal, on which the pulse modulation is executed by the modulator, with a pair of switching elements push-pull coupled with each other, a low pass filter adapted to smooth the amplified digital signal obtained by the power-amplification of the digital power amplifier, and a modulation period adjustment circuit adapted to adjust a modulation period of the pulse modulation of the modulator in accordance with a reset signal forming a basis of timing for driving an actuator.

6 Claims, 9 Drawing Sheets

LIQUID JET APPARATUS AND DRIVING METHOD FOR LIQUID JET APPARATUS

BACKGROUND

The entire disclosure of Japanese Patent Application No. 2007-337472 filed on Dec. 27, 2007 is expressly incorporated by reference herein.

1. Technical Field

The present invention relates to a liquid jet apparatus arranged to form predetermined characters and images by emitting microscopic droplets of liquids from a plurality of nozzles to form the microscopic particles (dots) thereof on a medium.

2. Related Art

Incidentally, in liquid jet printing apparatuses using the liquid jet apparatus, a drive signal amplified by a power amplifying circuit is applied to an actuator such as a piezoelectric element to emit a jet of a liquid from a nozzle, and if the drive signal is amplified by an analog power amplifier such as a linearly driven push-pull coupled transistor, a substantial power loss is caused, and a large heat sink for radiation is required. Therefore, according to JP-A-2005-329710, the drive signal is amplified using a digital power amplifier, thereby reducing the power loss, and eliminating the heat sink.

In the case of power-amplifying the drive signal using the digital power amplifier, it is a common practice to execute pulse modulation on a drive waveform signal acting as the basis for the drive signal, and to execute digital power amplification on the modulated signal. Incidentally, in the case of performing high-quality and high-speed printing with a one-pass operation using a line head printing apparatus, the time required for printing one dot is extremely short. For example, if a piezoelectric element is used as the actuator, it is required to pull in the liquid in the nozzle and then push it out to eject a jet of the liquid within the short time required for printing a dot, which requires a drive voltage signal with an accurate trapezoidal waveform. Since the drive waveform signal is as precise as the drive signal, in order for executing accurate pulse modulation on the precise drive waveform signal, it is required to always keeping the timing of the pulse modulation such as the phase of the triangular wave signal in pulse-width modulation in a constant condition with respect to the drive waveform signal.

Therefore, it is possible to adopt a method of resetting the timing of the pulse modulation such as the triangular wave signal itself using a reset signal forming the basis of actuator drive timing necessary for the case of performing printing with a line head printing apparatus, in other words, a reset signal forming the basis of drive signal generation timing.

However, by simply resetting the triangular wave signal in sync with the reset signal, the duty ratio of the modulated signal in the vicinity of the reset signal problematically varies, which causes a problem that the accurate drive signal cannot be obtained.

SUMMARY

The invention has an object of providing a liquid jet apparatus and a driving method thereof capable of assuring the duty ratio of the modulated signal conforming to the drive waveform signal to output an accurate drive signal when performing power-amplification using a digital power amplifier.

A liquid jet apparatus according to the invention includes a drive waveform generator adapted to generate a drive waveform signal, a modulator adapted to execute pulse modulation on the drive waveform signal, a digital power amplifier adapted to power-amplify the modulated signal, on which the pulse modulation is executed by the modulator, with a pair of switching elements push-pull coupled with each other, a low pass filter adapted to smooth the amplified digital signal obtained by the power-amplification of the digital power amplifier, and a modulation period adjustment circuit adapted to adjust a modulation period of the pulse modulation of the modulator in accordance with a reset signal forming a basis of timing for driving the actuator.

The modulation period in the invention denotes a basic unit period of the pulse modulation such as the triangular wave frequency of the pulse-width modulation (PWM) or the sampling frequency of the pulse-density modulation (PDM). It should be noted that the modulation period can be applied to the basic unit period of the pulse modulation in pulse-frequency modulation (PFM) or pulse-phase modulation (PPM).

According to the liquid jet apparatus of the invention, by adjusting the modulation period in accordance with the phase difference between the reset signal and the modulation period, it is possible to assure the duty ratio of the modulated signal conforming to the drive waveform signal to output the accurate drive signal.

Further, the liquid jet apparatus according to the invention has a feature that in the case in which the pulse modulation by the modulator is a pulse width modulation, the modulation period adjustment circuit detects a phase difference between a triangular wave signal of the modulator and the reset signal, and adjusts the modulation period of the pulse modulation in accordance with the phase difference.

Further, the liquid jet apparatus according to the invention has a feature that in the case in which the phase difference between the triangular wave signal of the modulator and the reset signal is equal to or smaller than a half of the period of the triangular wave signal, the modulation period adjustment circuit sets the period of the triangular wave signal subsequent to the reset signal to be a summed value of a predetermined reference period and the phase difference.

Further, the liquid jet apparatus according to the invention has a feature that in the case in which the phase difference between the triangular wave signal of the modulator and the reset signal is greater than a half of the period of the triangular wave signal, the modulation period adjustment circuit sets the period of the triangular wave signal subsequent to the reset signal to be the phase difference.

Further, a driving method of a liquid jet apparatus according to the invention includes generating a drive waveform signal forming a basis for driving an actuator for ejecting a liquid jet, executing a pulse modulation with a modulator on the drive waveform signal, power-amplifying the modulated signal on which the pulse modulation is executed with a pair of switching elements of a digital power amplifier push-pull coupled with each other, detecting, when smoothing the amplified digital signal thus power-amplified with a low pass filter and outputting the amplified digital signal thus smoothed towards the actuator, a phase difference between a triangular wave signal of the modulator and a reset signal in the case in which the pulse modulation by the modulator is a pulse width modulation, setting, in the case in which the phase difference between the triangular wave signal of the modulator and the reset signal is equal to or smaller than a half of the period of the triangular wave signal, the period of the triangular wave signal subsequent to the reset signal to be a summed value of a predetermined reference period and the phase difference, and setting, in the case in which the phase difference is greater than a half of the period of the triangular wave signal, the period of the triangular wave signal subsequent to the reset signal to be the phase difference.

According to the driving method of a liquid jet apparatus of the invention, it is possible to assure the duty ratio of the modulated signal conforming to the drive waveform signal to output the accurate drive signal.

DESCRIPTION OF EXEMPLARY EMBODIMENTS

An embodiment of a liquid jet printing apparatus using a liquid jet apparatus of the invention will hereinafter be explained.

Figure 1A:
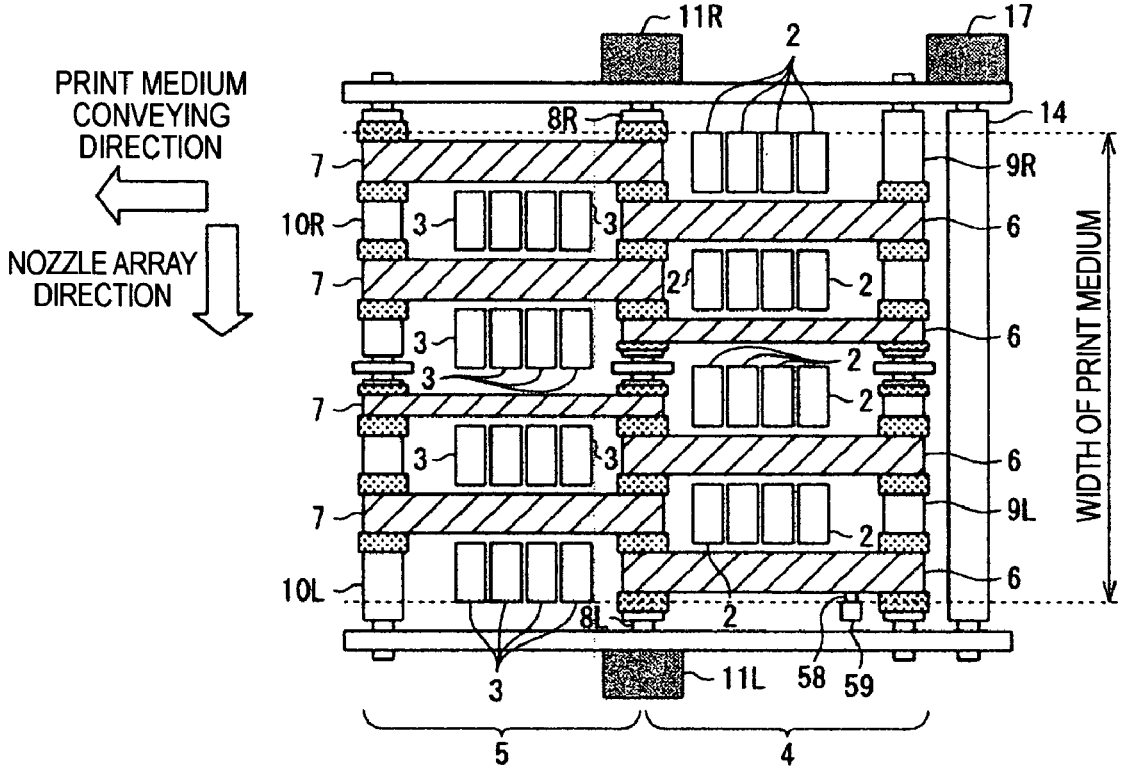
FIG. 1A is a plan view of a schematic configuration of a liquid jet printing apparatus using a liquid jet apparatus according to the invention.
Figure 1B:
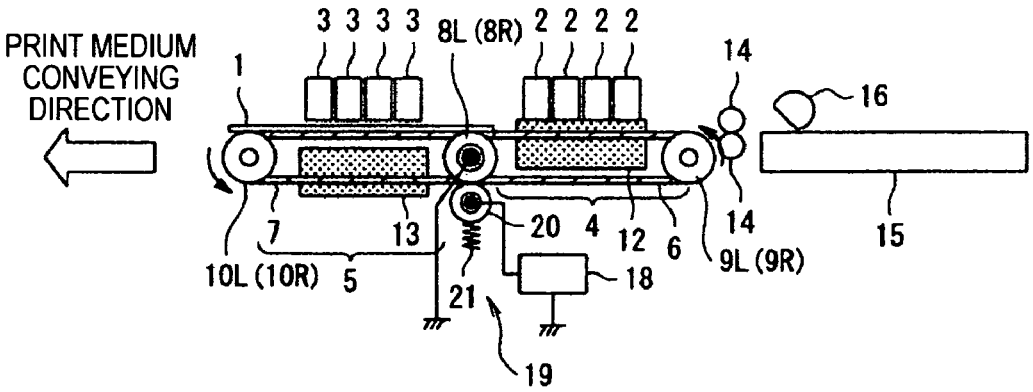
FIG. 1B is a front view of the schematic configuration of the liquid jet printing apparatus using the liquid jet apparatus according to the invention.

FIGS. 1A and 1B are schematic configuration diagrams of the liquid jet printing apparatus according to the present embodiment, wherein FIG. 1A is a plan view thereof, and FIG. 1B is a front view thereof. In FIGS. 1A and 1B, 1 in a line head printing apparatus, a print medium 1 is conveyed from right to left of the drawing along the arrow direction, and is printed in a print area in the middle of the conveying path.

The reference numeral 2 in the drawing denotes first liquid jet heads disposed on the upstream side in the conveying direction of the print medium 1, the reference numeral 3 denotes second liquid jet heads disposed similarly on the downstream side, a first conveying section 4 for conveying the print medium 1 is disposed below the first liquid jet heads 2, and a second conveying section 5 is disposed below the second liquid jet heads 3. The first conveying section 4 is composed of four first conveying belts 6 disposed with predetermined intervals in the direction (hereinafter also referred to as a nozzle array direction) traversing the conveying direction of the print medium 1, and the second conveying section 5 is similarly composed of four second conveying belts 7 disposed with predetermined intervals in the direction (the nozzle array direction) traversing the conveying direction of the print medium 1.

The four first conveying belts 6 and the similar four second conveying belts 7 are disposed alternately adjacent to each other. In the present embodiment, among the conveying belts 6, 7, the two first conveying belts 6 and the two second conveying belts 7 on the right side in the nozzle array direction are separated form the two first conveying belts 6 and the two second conveying belts 7 on the left side in the nozzle array direction. In other words, an overlapping portion of the two first conveying belts 6 and the two second conveying belts 7 on the right side in the nozzle array direction is provided with a right side drive roller 8R, an overlapping portion of the two first conveying belts 6 and the two second conveying belts 7 on the left side in the nozzle array direction is provided with a left side drive roller 8L, right side first driven roller 9R and left side first driven roller 9L are disposed on the upstream side thereof, and right side second driven roller 10R and left side second driven roller 10L are disposed on the downstream side thereof. Although these rollers may seem a series of rollers, actually they are decoupled at the center portion of FIG. 1A.

Further, the two first conveying belts 6 on the right side in the nozzle array direction are wound around the right side drive roller 8R and the right side first driven roller 9R, the two first conveying belts 6 on the left side in the nozzle array direction are wound around the left side drive roller 8L and the left side first driven roller 9L, the two second conveying belts 7 on the right side in the nozzle array direction are wound around the right side drive roller 8R and the right side second driven roller 10R, the two second conveying belts 7 on the left side in the nozzle array direction are wound around the left side drive roller 8L and the left side second driven roller 10L, and further, a right side electric motor 11R is coupled to the right side drive roller 8R, and a left side electric motor 11L is coupled to the left side drive roller 8L.

Therefore, when the right side electric motor 11R rotationally drives the right side drive roller 8R, the first conveying section 4 composed of the two first conveying belts 6 on the right side in the nozzle array direction and similarly the second conveying section 5 composed of the two second conveying belts 7 on the right side in the nozzle array direction move in sync with each other and at the same speed, while the left side electric motor 11L rotationally drives the left side drive roller 8L, the first conveying section 4 composed of the two first conveying belts 6 on the left side in the nozzle array direction and similarly the second conveying section 5 composed of the two second conveying belts 7 on the left side in the nozzle array direction move in sync with each other and at the same speed. It should be noted that by arranging the rotational speeds of the right side electric motor 11R and the left side electric motor 11L to be different from each other, the conveying speeds on the left and right in the nozzle array direction can be set to be different from each other, and specifically, by arranging the rotational speed of the right side electric motor 11R to be higher than the rotational speed of the left side electric motor 11L, the conveying speed on the right side in the nozzle array direction can be made higher than that on the left side, and by arranging the rotational speed of the left side electric motor 11L to be higher than the rotational speed of the right side electric motor 11R, the conveying speed on the left side in the nozzle array direction can be made higher than that on the right side. Further, by thus controlling the conveying speeds on the respective sides in the nozzle array direction, namely the direction traversing the conveying direction, it becomes possible to control the conveying posture of the print medium 1. It should be noted that among the four first conveying belts 6 of the first conveying section 4, the first belt 6 at the lower end in FIG. 1A is provided with a tab 58 protruding outward in the belt width direction, passage of the tab 58 is detected by a tab sensor 59, and the detection signal (a reset signal rst) thereof is used as a reference of drive timing of the actuators, namely a reference of generation timing of a drive signal (or drive pulses) described later.

The first liquid jet heads 2 and the second liquid jet heads 3 are disposed so as to be shifted from each other in the conveying direction of the print medium 1 corresponding respectively to the four colors, such as yellow (Y), magenta (M), cyan (C), and black (K). The liquid jet heads 2, 3 are supplied with liquids such as ink from liquid tanks of respective colors not shown via liquid supply tubes. The liquid jet heads 2, 3 are each provided with a plurality of nozzles formed in the direction traversing the conveying direction of the print medium 1, and by emitting a necessary amount of the liquid jet from the respective nozzles simultaneously to the necessary positions, microscopic dots are formed on the print medium 1. By executing the process described above for each of the colors, one-pass print can be achieved only by making the print medium 1 conveyed by the first and second conveying sections 4, 5 pass therethrough once.

As a method of emitting a liquid jet from each of the nozzles of the liquid jet head, there are cited electrostatic driving method, piezoelectric driving method, film boiling liquid jet method, and so on, and in the present embodiment there is used the piezoelectric driving method. In the piezoelectric driving method, when a drive signal is provided to a piezoelectric element as an actuator, a diaphragm in a cavity is displaced to cause pressure variation in the cavity, and the liquid jet is emitted from the nozzle in response to the pressure variation. Further, by controlling the wave height and the voltage variation gradient of the drive signal, it becomes possible to control the amount of liquid jet to be emitted therefrom. It should be noted that the actuator formed of a piezoelectric element is a capacitive load having a capacitance.

The nozzles of the first liquid jet head 2 are only provided between the four first conveying belts 6 of the first conveying section 4, and the nozzles of the second liquid jet head 3 are only provided between the four second conveying belts 7 of the second conveying section 5. Although this is for cleaning each of the liquid jet heads 2, 3 with a cleaning section described later, in this case, the entire surface is not printed by the one-pass printing if either one of the liquid jet heads is used. Therefore, the first liquid jet heads 2 and the second liquid jet heads 3 are disposed so as to be shifted in the conveying direction of the print medium 1 in order for compensating for each other's unprintable areas.

Below the first liquid jet heads 2, there are disposed first cleaning caps 12 for cleaning the first liquid jet heads 2, and below the second liquid jet heads 3 there are disposed second cleaning caps 13 for cleaning the second liquid jet heads 3. Each of the cleaning caps 12, 13 is formed to have a size allowing the cleaning caps to pass through the gaps between the four first conveying belts 6 of the first conveying section 4 and the gaps between the four second conveying belts 7 of the second conveying section 5. Each of the cleaning caps 12, 13 is composed of a cap body having a rectangular shape with a bottom, covering the nozzles provided to the lower surface, namely a nozzle surface of the liquid jet head 2, 3, and capable of adhering to the nozzle surface, a liquid absorber disposed at the bottom thereof, a peristaltic pump connected to the bottom of the cap body, and an elevating device for moving the cap body up and down. Then, the cap body is moved up by the elevating device to be adhered to the nozzle surface of the liquid jet head 2, 3. By applying the negative pressure in the cap body using the peristaltic pump in the present state, the liquid and bubbles are suctioned from the nozzles opened on the nozzle surface of the liquid jet head 2, 3, thus the cleaning of the liquid jet head 2, 3 can be performed. After the cleaning is completed, each of the cleaning caps 12, 13 is moved down.

On the upstream side of the first driven rollers 9R, 9L, there is provided a pair of gate rollers 14 for adjusting the feed timing of the print medium 1 fed from a feeder section 15 and at the same time correcting the skew of the print medium 1. The skew denotes a turn of the print medium 1 with respect to the conveying direction. Further, above the feeder section 15, there is provided a pickup roller 16 for feeding the print medium 1. It should be noted that the reference numeral 17 in the drawing denotes a gate roller motor for driving the gate rollers 14.

A belt charging device 19 is disposed below the drive rollers 8R, 8L. The belt charging device 19 is composed of charging rollers 20 each having contact with the first conveying belts 6 and the second conveying belts 7 by pinching the first conveying belts 6 and the second conveying belts 7 between the charging rollers and the drive rollers 8R, 8L, a spring 21 for pressing the charging rollers 20 against the first conveying belts 6 and the second conveying belts 7, and a power supply 18 for providing charge to the charging rollers 20, and charges the first conveying belts 6 and the second conveying belts 7 by providing the first conveying belts 6 and the second conveying belts 7 with the charge from the charging rollers 20. Since the belts are generally made of a moderate or high resistivity material or an insulating material, when they are charged by the belt charging device, the charge applied on the surface thereof causes the dielectric polarization on the print medium 1 made similarly of a high resistivity material or an insulating material, and the print medium 1 can be absorbed to the belt by the electrostatic force caused between the charge generated by the dielectric polarization and the charge on the surface of the belt. It should be noted that as the belt charging means, a corotron method for showering the charges can also be used.

Therefore, according to the liquid jet printing apparatus using the liquid jet apparatus of the first embodiment, when the surfaces of the first conveying belts 6 and the second conveying belts 7 are charged by the belt charging device, the print medium 1 is fed from the gate roller 14 in that state, and the print medium 1 is pressed against the first conveying belts 6 by a sheet pressing roller not shown, the print medium 1 is absorbed by the surfaces of the first conveying belts 6 under the action of dielectric polarization described above. In this state, when the electric motors 11R, 11L rotationally drive the drive rollers 8R, 8L, the rotational drive force is transmitted to the first driven rollers 9R, 9L via the first conveying belts 6.

Thus, while the first conveying belts 6 are moved to the downstream side in the conveying direction with the print medium 1 absorbed thereto to move the print medium 1 below the first liquid jet heads 2, printing is performed by emitting liquid jets from the nozzles provided to the first liquid jet heads 2. When the printing by the first liquid jet heads 2 is completed, the print medium 1 is moved towards downstream side in the conveying direction to be transferred to the second conveying belts 7 of the second conveying section 5. As described above, since the second conveying belts 7 are also provided with the charge on the surfaces thereof by the belt charging device, the print medium 1 is absorbed by the surfaces of the second conveying belts 7 under the action of the dielectric polarization described above.

In this state, while the second conveying belts 7 is moved towards the downstream side in the conveying direction to move the print medium 1 below the second liquid jet heads 3, printing is performed by emitting liquid jets from the nozzles provided to the second liquid jet heads 3. After the printing by the second liquid jet heads 3 is completed, the print medium 1 is moved further to the downstream side in the conveying direction, the print medium 1 is ejected to a catch tray while being separated from the surfaces of the second conveying belts 7 by a separating device not shown in the drawings.

Further, when the cleaning of the first and second liquid ejection heads 2, 3 is necessary, the first and second cleaning caps 12, 13 are raised to be adhered to the nozzle surfaces of the first and second liquid jet heads 2, 3 as described above, the cleaning is performed by applying negative pressure to the inside of the caps at that state to suction the liquid and bubbles from the nozzles of the first and second liquid jet heads 2, 3, and after then, the first and second cleaning caps 12, 13 are moved down.

Figure 2:
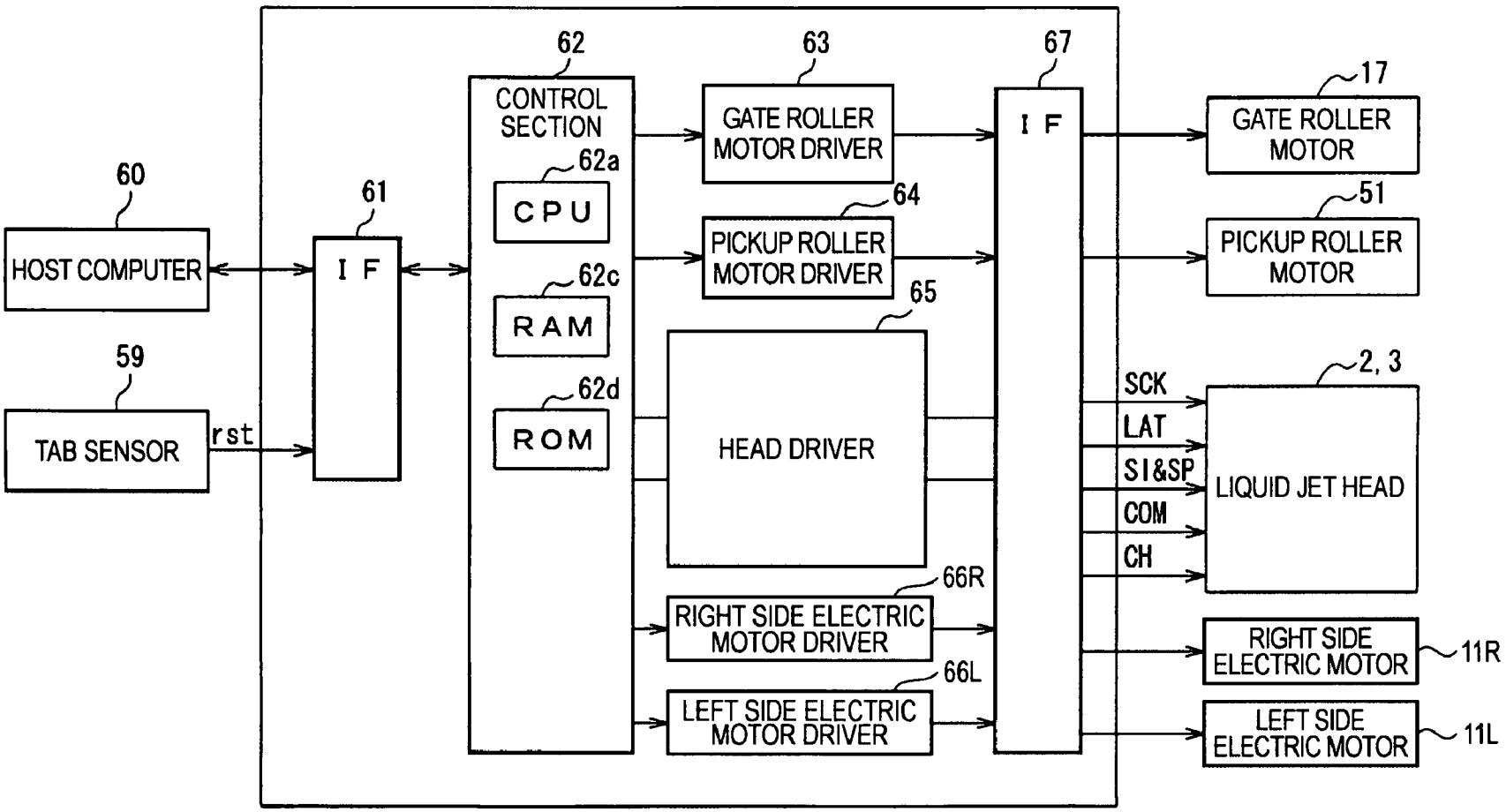
FIG. 2 is a block diagram of a control device of the liquid jet printing apparatus.

In the liquid jet printing apparatus using the liquid jet apparatus of the present embodiment, there is provided a control device for controlling the liquid jet printing apparatus. As shown in FIG. 2, the control device is configured including an input interface 61 for receiving print data input from the host computer 60 and inputting the reset signal rst from the tab sensor 59, a control section 62 formed of a microcomputer for performing the print process based on the print data and the reset signal input from the input interface 61, a gate roller motor driver 63 for controlling and driving the gate roller motor 17, a pickup roller motor driver 64 for controlling and driving a pickup roller motor 51 for driving the pickup roller 16, a head driver 65 for controlling and driving the liquid jet heads 2, 3, a right side electric motor driver 66R for controlling and driving the right side electric motor 11R, a left side electric motor driver 66L for controlling and driving the left side electric motor 11L, and an interface 67 for connecting the gate roller motor driver 63, the pickup roller motor driver 64, the head driver 65, the right side electric motor driver 66R, and the left side electric motor driver 66L respectively to the gate roller motor 17, the pickup roller motor 51, the liquid jet heads 2, 3, the right side electric motor 11R, and the left side electric motor 11L.

The control section 62 is provided with a central processing unit (CPU) 62*a* for performing various processes such as a printing process, a random access memory (RAM) 62*c* for temporarily stores the print data input via the input interface 61 and various kinds of data used in performing the printing process of the print data, and for temporarily developing a program, for example, for the printing process, and a read-only memory (ROM) 62*d* formed of a nonvolatile semiconductor memory and for storing, for example, the control program executed by the CPU 62*a*. When the control section 62 receives the print data (the image data) from the host computer 60 via the interface section 61, the CPU 62*a* executes a predetermined process on the print data to calculate nozzle selection data and drive signal output data to the actuators regarding which nozzle emits the liquid jet or how much liquid jet is emitted, and outputs the drive signals and the control signals to the gate roller motor driver 63, the pickup roller motor driver 64, the head driver 65, the right side electric motor driver 66R, and the left side electric motor driver 66L, respectively, based on the print data, drive signal output data, and the input data from the various sensors. In response to the drive signals and the control signals, the actuators 22 corresponding to the plurality of nozzles of the liquid jet heads 2, 3, the gate roller motor 17, the pickup roller motor 51, the right side electric motor 11R, and the left side electric motor 11L respectively operate to execute the feeding and conveying of the print medium 1, the posture control of the print medium 1, and the printing process on the print medium 1. It should be noted that the constituents inside the control section 62 are electrically connected to each other via a bus not shown in the drawings.

Figure 3:
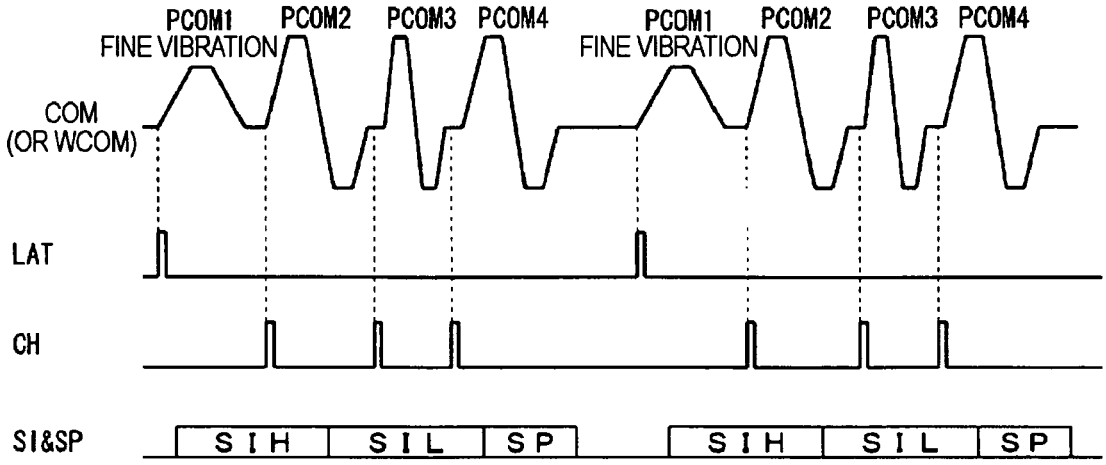
FIG. 3 is an explanatory diagram of a drive signal for driving an actuator.

FIG. 3 shows an example of a drive signal COM supplied from the control device of the liquid jet printing apparatus using the liquid jet apparatus according to the present embodiment to the liquid jet heads 2, 3, and for driving the actuators 22 each formed of a piezoelectric element. In the first embodiment, it is assumed that the signal has an electric potential varying around a midpoint potential. The drive signal COM is formed by connecting, in a time-series manner, drive pulses PCOM as unit drive signals for driving the actuator 22 so as to emit a liquid jet, wherein the rising section of each of the drive pulses PCOM corresponds to a stage of expanding the volume of the cavity (the pressure chamber) communicating with the nozzle to pull in the liquid (it can also be said that the meniscus is pulled in, in view of the surface of the liquid to be emitted), the falling section of each of the drive pulses PCOM corresponds to a stage of reducing the volume of the cavity to push out the liquid (it can also be said that the meniscus is pushed out, in view of the surface of the liquid to be emitted), and as a result of pushing out the liquid, the liquid jet is emitted from the nozzle.

By variously modifying the gradient of increase and decrease in voltage and the height of the drive pulse formed of this trapezoidal voltage wave, the pull-in amount and the pull-in speed of the liquid, and the push-out amount and the push-out speed of the liquid can be modified, thus the amount of liquid jet can be varied to obtain the liquid dots with different sizes. Therefore, in the case in which a plurality of drive pulses PCOM are sequentially joined, it is possible to select the single drive pulse PCOM from the drive pulses to be supplied to the actuator to emit the liquid jet, or to select the two or more drive pulses PCOM to be supplied to the actuator to emit the liquid jet two or more times, thereby obtaining the dots with various sizes. In other words, when the two or more liquid droplets land on the same position before the liquid is dried, it brings substantially the same result as emitting a larger amount of liquid jet, thus the size of the dot can be enlarged. By a combination of such technologies, it becomes possible to achieve multiple tone printing. It should be noted that the drive signal COM shown in the left end of FIG. 3 is only for pulling in the liquid but not for pushing out the liquid. This is called a fine vibration, and is used for preventing thickening in the nozzle without emitting the liquid jet.

As a result of the above, in the liquid jet head 2, 3 there are input the drive signal COM output from the drive signal output circuit described later, the drive pulse selection data SI&SP for selecting the nozzle to emit the liquid jet and determining the coupling timing of the actuator 22 such as a piezoelectric element to the drive signal COM based on the print data, the latch signal LAT and a channel signal CH for coupling the drive signals COM with the actuators 22 of the liquid jet head 2, 3 to each other based on the drive pulse selection data SI&SP after the nozzle selection data is input to all of the nozzles, and the clock signal SCK for transmitting the drive pulse selection data SI&SP to the liquid jet head 2, 3 as a serial signal. It should be noted that it is hereinafter assumed that the minimum unit of the drive signal for driving the actuator 22 is the drive pulse PCOM, and the entire signal having the drive pulses PCOM coupled with each other in a time series manner is described as the drive signal COM.

Figure 4:
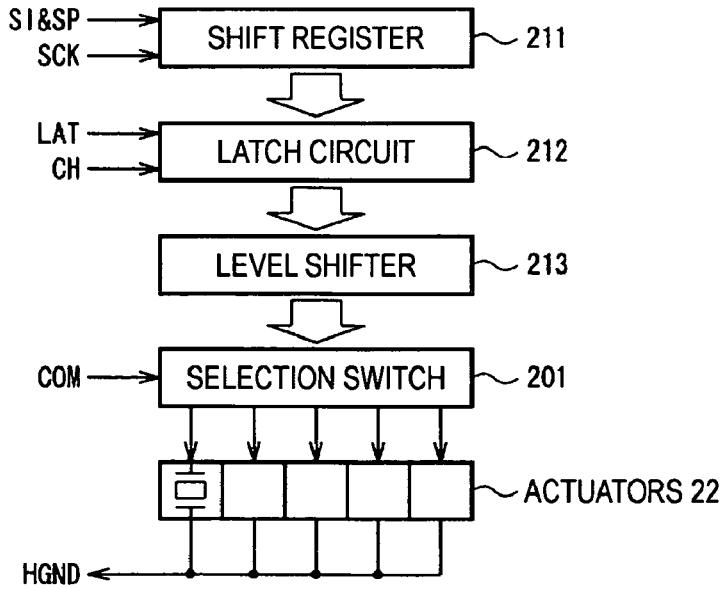
FIG. 4 is a block diagram of a selection section for coupling drive signals with actuators.

Then, the configuration of coupling the drive signals COM output from the drive circuit with the actuators 22 such as a piezoelectric element will be explained. FIG. 4 is a block diagram of the selection section for coupling the drive signals COM with the actuators such as the piezoelectric elements. The selection section is composed of a shift register 211 for storing the drive pulse selection data SI&SP for designating the actuator 22 such as a piezoelectric element corresponding to the nozzle from which the liquid jet is to be emitted, a latch circuit 212 for temporarily storing the data of the shift register 211, a level shifter 213 for executing level conversion on the output of the latch circuit 212, and a selection switch 201 for coupling the drive signal COM with the actuator 22 such as a piezoelectric element in accordance with the output of the level shifter.

The drive pulse selection data SI&SP is sequentially input to the shift register 211, and at the same time, the storage area is sequentially shifted from the first stage to the subsequent stage in accordance with the input pulse of the clock signal SCK. The latch circuit 212 latches the output signals of the shift register 211 in accordance with the latch signal LAT input thereto after the drive pulse selection data SI&SP corresponding to the number of the nozzles is stored in the register 211. The signals stored in the latch circuit 212 are converted by the level shifter 213 so as to have the voltage levels capable of switching on and off the selection switch 201 on the subsequent stage. This is because the drive signal COM has a high voltage compared to the output voltage of the latch circuit 212, and the operating voltage range of the selection switch 201 is also set to be higher accordingly. Therefore, the actuator 22 such as a piezoelectric element the selection switch 201 of which is closed by the level shifter 213 is coupled with the drive signal COM (the drive pulse PCOM) at the coupling timing of the drive pulse selection data SI&SP. Further, after the drive pulse selection data SI&SP of the shift register 211 is stored in the latch circuit 212, the subsequent print information is input to the shift register 211, and the stored data of the latch circuit 212 is sequentially updated in sync with the liquid jet emission timing. It should be noted that the reference symbol HGND in the drawing denotes the ground terminal for the actuators 22 such as the piezoelectric elements. Further, according to the selection switch 201, even after the actuator 22 such as the piezoelectric element is separated from the drive signal COM (the drive pulse PCOM) the input voltage of the actuator 22 is maintained at the voltage applied thereto immediately before it is separated.

Figure 5:
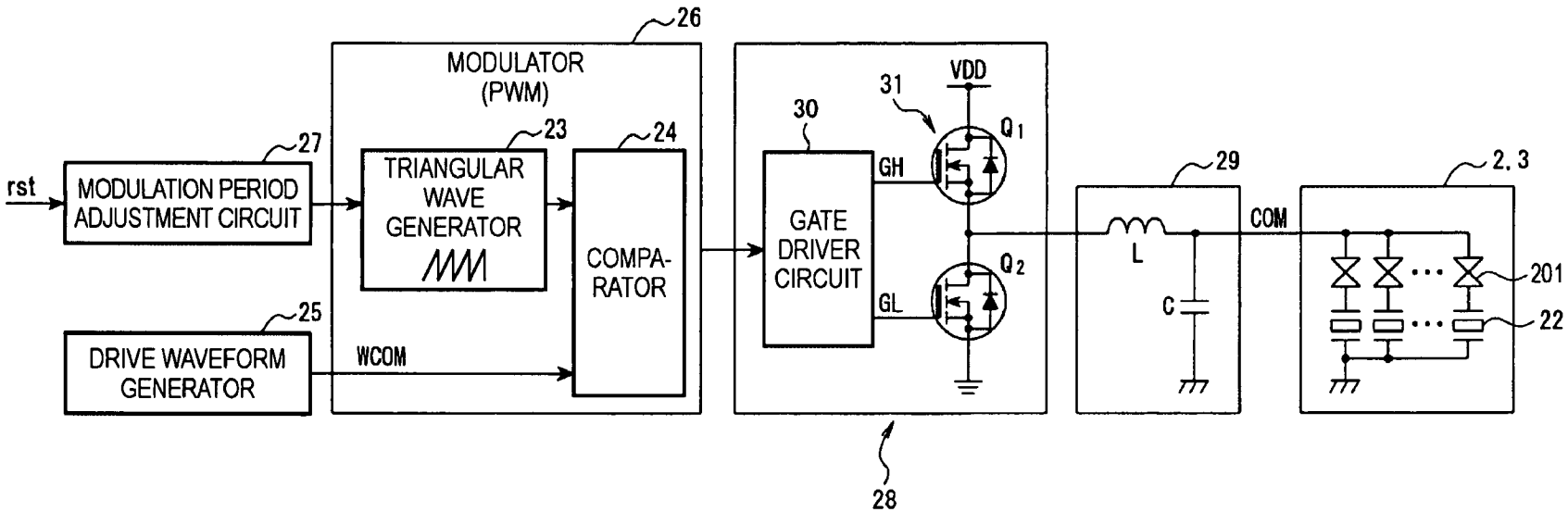
FIG. 5 is a block diagram of a drive signal output circuit built up in a head driver shown in FIG. 2.

FIG. 5 shows an example of a specific configuration of the drive signal output circuit in the head driver 65 for driving the actuator 22. The liquid jet heads 2, 3 forming the liquid jet printing apparatus are provided with a number of nozzles each provided with the actuator 22 described above. On the upstream side of each of the actuators 22, there is disposed the selection switch 201 formed of a transmission gate, each of the selection switches 201 is switched on and off by a nozzle selection control circuit, not shown, in accordance with the print data, and the drive signal COM (the drive pulse PCOM) is applied to only the actuator 22 the selection switch 201 of which is switched on.

On the other hand, the drive signal output circuit is configured including a drive waveform generator 25 for generating a drive waveform signal WCOM forming a base of the drive signal COM (the drive pulse PCOM), namely a basis of a signal for controlling driving of the actuators 22 based on the drive signal output data from the control section 62, a modulator 26 for executing pulse modulation on the drive waveform signal WCOM generated by the drive waveform generator 25, a digital power amplifier 28 for power-amplifying the modulated signal on which the pulse modulation is executed by the modulator 26, and a low pass filter 29 for smoothing the amplified digital signal power-amplified by the digital power amplifier 28 and supplying the nozzle actuators 22 with the amplified digital signal thus smoothed as the drive signal COM (the drive pulse PCOM).

The drive waveform generator 25 combines a predetermined digital electric potential data in a time-series manner to output the combination as the drive waveform signal WCOM. In the present embodiment, as the modulator 26 for performing the pulse modulation on the drive waveform signal WCOM, there is used a typical pulse width modulation (PWM) circuit. In the pulse width modulation, the triangular wave generator 23 generates a triangular wave signal with a predetermined frequency, and a comparator 24 compares the triangular wave signal with the drive waveform signal WCOM to output a pulse signal, which takes on-duty when, for example, the drive waveform signal WCOM is greater than the triangular wave signal, as the modulated signal. The digital power amplifier 28 is configured including a half-bridge output stage 31 formed of a high-side switching element Q1 and a low-side switching element Q2 for substantially amplifying the power, and a gate driver circuit 30 for controlling gate-source signals GH, GL of the switching elements Q1, Q2 based on the modulated signal from the modulator 26. Further, the low pass filter 29 is formed of a low pass filter composed of a combination of inductors L and capacitances C, and the low pass filter eliminates the modulation period component of the amplified digital signal, namely the frequency component of the triangular wave signal in this case.

In the digital power amplifier 28, when the modulated signal is in an Hi level, the gate-source signal GH of the high-side switching element Q1 becomes in the Hi level and the gate-source signal GL of the low-side switching element Q2 becomes in an Lo level, and consequently, the high-side switching element Q1 becomes in the ON state, and the low-side switching element Q2 becomes in the OFF state, and as a result, the output of the half-bridge output stage 31 becomes to have the power supply voltage VDD. On the other hand, when the modulated signal is in the Lo level, the gate-source signal GH of the high-side switching element Q1 becomes in the Lo level and the gate-source signal GL of the low-side switching element Q2 becomes in the Hi level, and consequently, the high-side switching element Q1 becomes in the OFF state, and the low-side switching element Q2 becomes in the ON state, and as a result, the output of the half-bridge output stage 31 becomes 0.

Although a current flows through the switching element in the ON state when the high-side and low-side switching elements Q1, Q2 are driven digitally as described above, the resistance value between the drain and the source is extremely small, and therefore, only a little loss is caused. Further, since no current flows in the switching element in the OFF state, the power loss does not occur. Therefore, since the loss of the digital power amplifier 28 is extremely small, a switching element such as a small-sized MOSFET can be used therefor, and cooling means such as a heat radiation plate for cooling can also be eliminated. Incidentally, the efficiency in the case in which the transistor is driven in the linear range is about 30% while the efficiency of digital power amplifier 28 is 90% or higher. Further, since the heat radiation plate for cooling the transistor requires about 60 mm square in size for each transistor, if such a radiation plate for cooling can be eliminated, an overwhelming advantage in the actual layout can be obtained.

Figure 6:
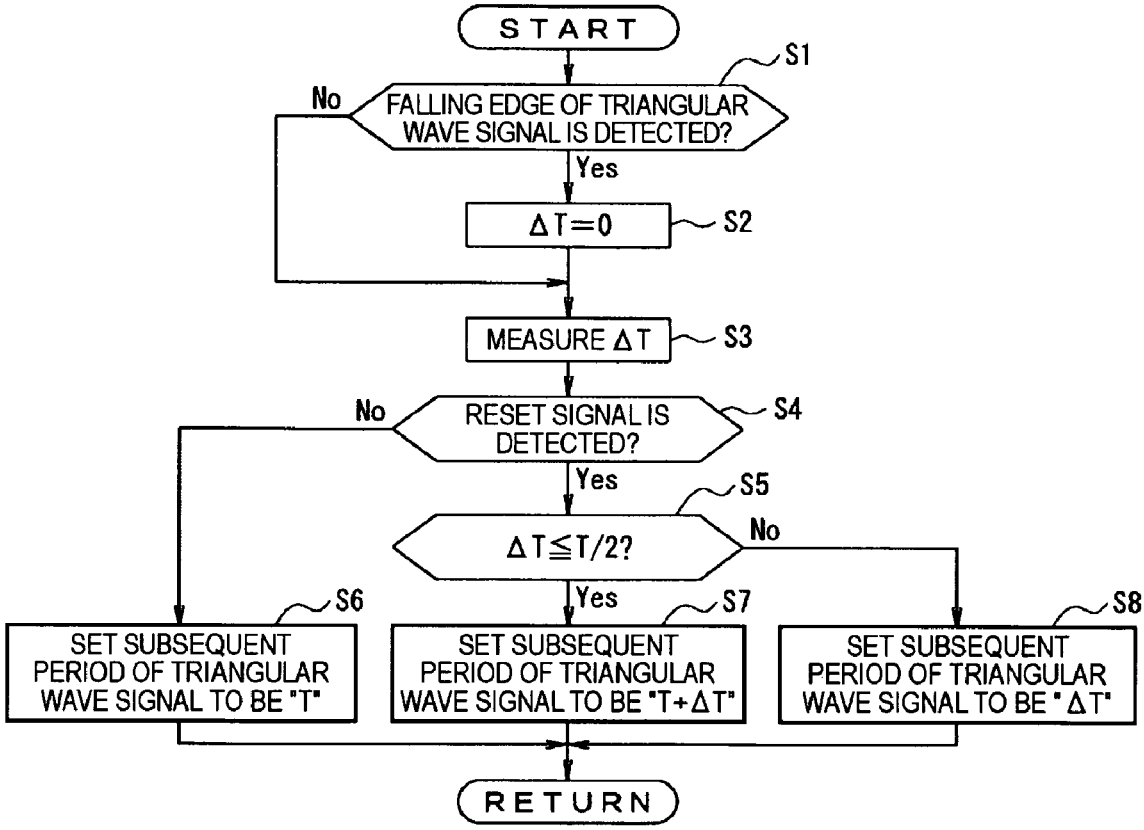
FIG. 6 is a flowchart of arithmetic processing executed in a modulation period adjustment circuit shown in FIG. 5.

The frequency of the triangular wave signal generated by the triangular wave generator 23, namely the modulation period can be modified and set by a modulation period adjustment circuit 27. In the modulation period adjustment circuit 27, the arithmetic processing shown in FIG. 6 is executed in a predetermined cycle. In the arithmetic processing shown in FIG. 6, firstly in the step S1, whether or not a falling edge of the triangular wave signal is detected is determined, and if the falling edge of the triangular wave signal is detected, the process proceeds to the step S2, and otherwise the process proceeds to the step S3.

In the step S2, the phase difference ΔT between the triangular wave signal and the reset signal is reset to be 0, and the process proceeds to the step S3.

In the step S3, the phase difference ΔT between the triangular wave signal and the reset signal rst is measured (counted up).

Subsequently, the process proceeds to the step S4 to determine whether or not the reset signal rst is detected, and if the reset signal rst has been detected, the process proceeds to the step S5, otherwise the process proceeds to the step S6.

In the step S6, the subsequent period of the triangular wave signal is set to be a predetermined reference period T, and then the process proceeds to the main program.

In the step S5, whether or not the phase difference ΔT between the triangular wave signal and the reset signal rst is equal to or smaller than a half value T/2 of the reference period T, and if the phase difference ΔT is equal to or smaller than the half value T/2 of the reference period T, the process proceeds to the step S7, otherwise the process proceeds to the step S8.

In the step S7, the subsequent period of the triangular wave signal is set to be a summed value T+ΔT of the reference period T and the phase difference ΔT, and then the process returns to the main program.

On the other hand, in the step S8, the subsequent period of the triangular wave signal is set to be the phase difference ΔT between the triangular wave signal and the reset signal rst, and then the process returns to the main program.

Figure 7A:
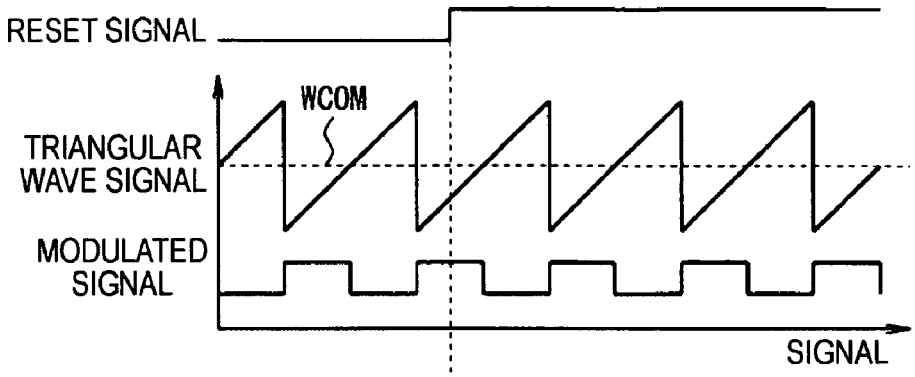
FIGS. 7A, 7B, and 7C are explanatory diagrams of a modulated signal in the case in which a phase difference between a triangular wave signal and a reset signal is equal to or smaller than a half value of a reference period of the triangular wave signal.
Figure 7B:
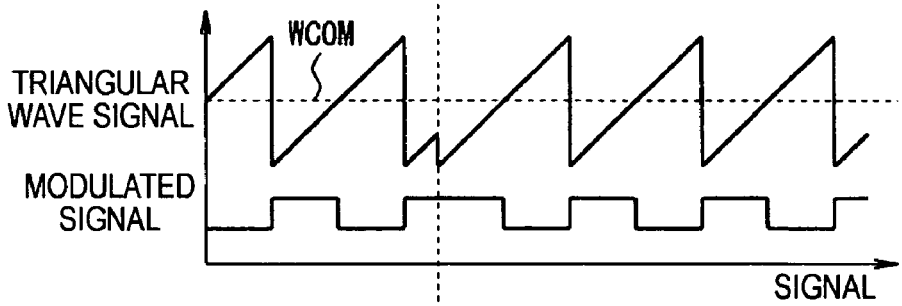
Figure 7C:
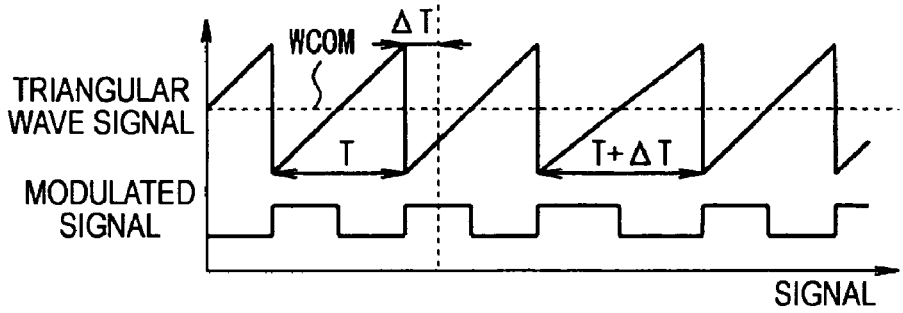
Figure 8A:
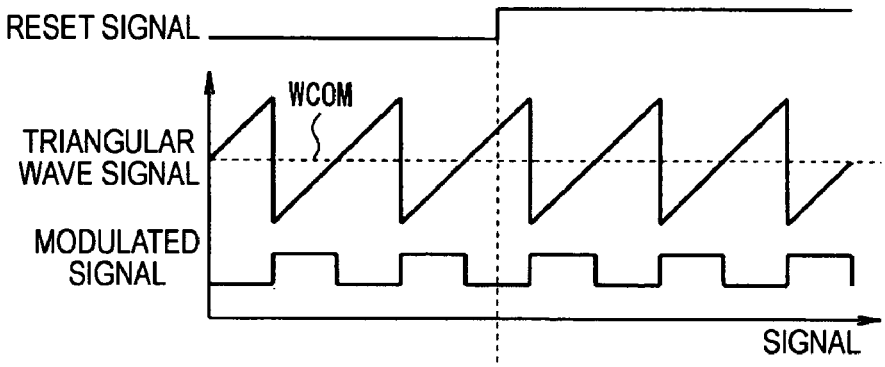
FIGS. 8A, 8B, and 8C are explanatory diagrams of the modulated signal in the case in which the phase difference between the triangular wave signal and the reset signal is greater than the half value of the reference period of the triangular wave signal.
Figure 8B:
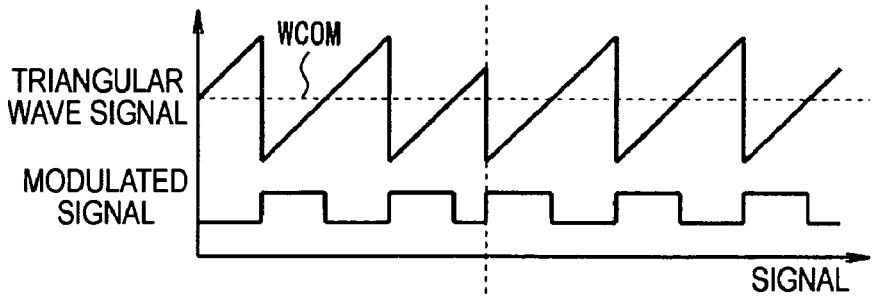
Figure 8C:
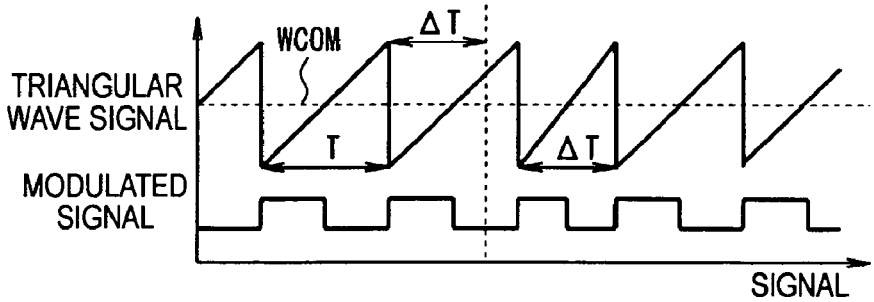

In FIGS. 7A, 7B, and 7C, the case in which the phase difference ΔT between the falling edge of the triangular wave signal and the rising edge of the reset signal is equal to or smaller than the half value T/2 of the reference period T of the triangular wave signal is assumed, wherein FIG. 7A shows the modulated signal in the case in which the triangular wave signal is continuously output regardless of the reset signal rst, FIG. 7B shows the modulated signal in the case in which the triangular wave signal is reset in sync with the rising edge of the reset signal rst, and FIG. 7C shows the modulated signal in the case of the present embodiment. Similarly, in FIGS. 8A, 8B, and 8C, the case in which the phase difference ΔT between the falling edge of the triangular wave signal and the rising edge of the reset signal is greater than the half value T/2 of the reference period T of the triangular wave signal is assumed, wherein FIG. 8A shows the modulated signal in the case in which the triangular wave signal is continuously output regardless of the reset signal rst, FIG. 8B shows the modulated signal in the case in which the triangular wave signal is reset in sync with the rising edge of the reset signal rst, and FIG. 8C shows the modulated signal in the case of the present embodiment. It should be noted that the drive waveform signal WCOM is assumed to be a constant value for the sake of easy understanding.

For example, assuming the rising edge of the reset signal rst to be the timing of generation of the drive signal COM (the drive pulse PCOM), as shown in FIGS. 7A and 8A, if the triangular wave signal is continuously output regardless of the reset signal rst, the phase state of the triangular wave signal with respect to the drive waveform signal WCOM is no longer kept constant, and therefore, the modulated signal varies. In contrast, as shown in FIGS. 7B and 8B, if the triangular wave signal is reset in sync with the rising edge of the reset signal rst, it is possible to always keep the phase state of the triangular wave signal with respect to the drive waveform signal WCOM constant, and to keep the state of the modulated signal constant. However, as shown particularly in FIG. 7B, if the triangular wave signal is reset in sync with the rising edge of the reset signal, there is a possibility that the on-duty period of the modulated signal increases to increase the duty ratio thereof up to about two times as large as the original duty ratio of the drive waveform signal WCOM. In contrast, as shown in FIGS. 7C and 8C, in the case of adjusting the modulation period of the triangular wave signal subsequent to the reset signal rst in accordance with the phase difference ΔT between the reset signal rst and the triangular wave signal, although a phase shift is caused in the pulse modulation of the drive waveform signal WCOM with the triangular wave signal at the rising edge of the reset signal rst, the pulse modulation of the drive waveform signal WCOM with the next period and the following periods of the triangular wave signal becomes the same as in the case of resetting the triangular wave signal in sync with the rising edge of the reset signal rst. In particular, in the case in which the phase difference ΔT between the reset signal rst and the triangular wave signal is equal to or smaller than the half value T/2 of the reference period T, the period of the triangular wave signal subsequent to the reset signal rst is set to be the summed value T+ΔT of the reference period T and the phase difference ΔT, and in the case in which the phase difference ΔT between the reset signal rst and the triangular wave signal is greater than the half value T/2 of the reference period T, the period of the triangular wave signal subsequent to the reset signal rst is set to be the phase difference ΔT, thereby making it possible to suppress the variation in the duty ratio of the pulse modulation of the drive waveform signal WCOM with the period of the triangular wave signal subsequent to the reset signal rst.

Figure 9A:
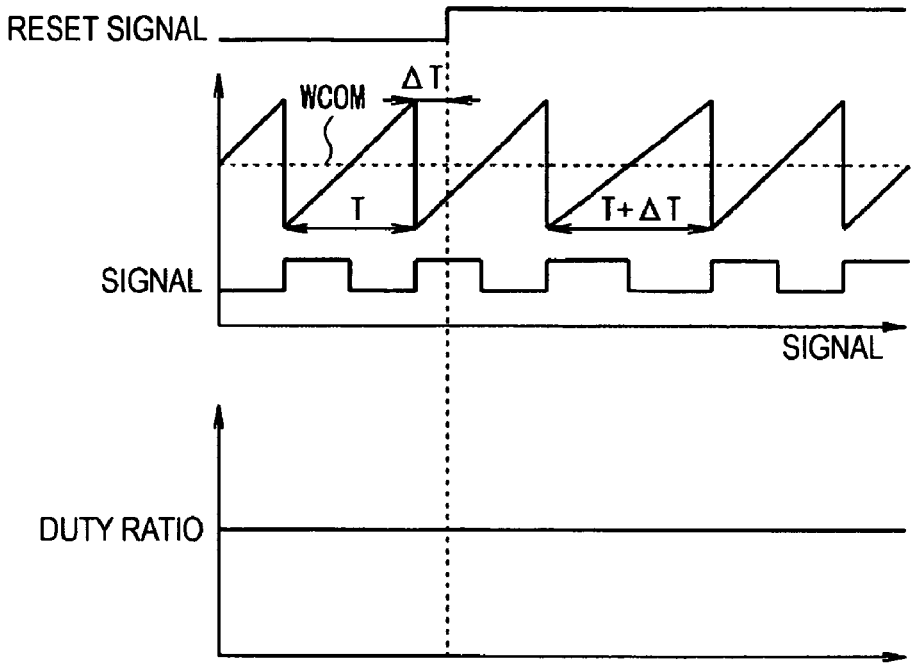
FIGS. 9A and 9B are explanatory diagrams of the modulated signal and the drive signal by arithmetic processing shown in FIG. 5 in the case in which the phase difference between the triangular wave signal and the reset signal is equal to or smaller than the half value of the reference period of the triangular wave signal.
Figure 9B:
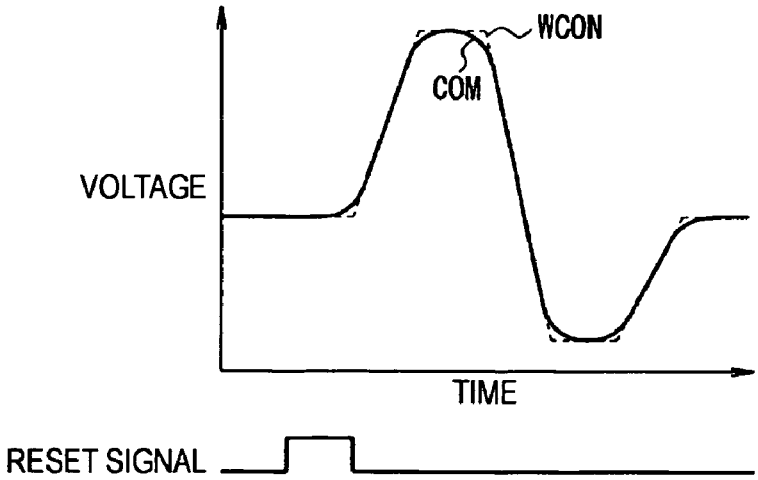

In FIGS. 9A and 9B, the case in which the phase difference ΔT between the falling edge of the triangular wave signal and the rising edge of the reset signal is equal to or smaller than the half value T/2 of the reference period T of the triangular wave signal is assumed similarly to the case shown in FIGS. 7A, 7B, and 7C, wherein FIG. 9A shows the modulated signal in the present embodiment, and FIG. 9B shows the drive signal COM in the present embodiment. The drive waveform signal WCOM is assumed to have a constant voltage value to provide the duty ratio of 50%. According to the pulse modulation of the present embodiment, the duty ratio is constant even in the vicinity of the rising edge of the reset signal rst, and the drive signal COM also follows well to the drive waveform signal WCOM.

Figure 10A:
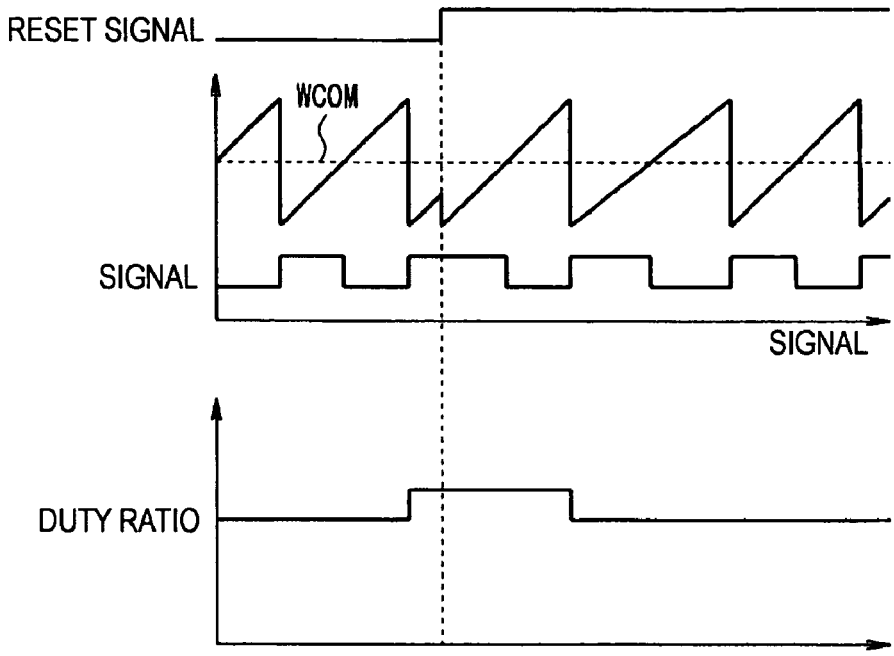
FIGS. 10A and 10B are explanatory diagrams of the modulated signal and the drive signal when resetting the triangular wave signal in accordance with the reset signal in the case in which the phase difference between the triangular wave signal and the reset signal is equal to or smaller than the half value of the reference period of the triangular wave signal.
Figure 10B:
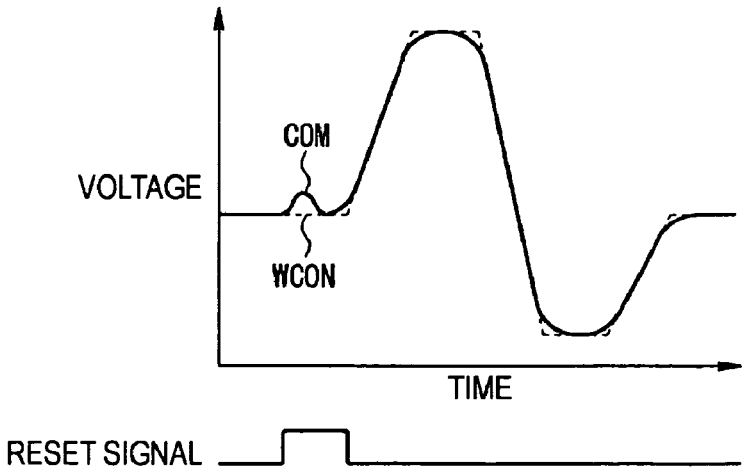

In contrast, in FIGS. 10A and 10B, the case in which the phase difference ΔT between the falling edge of the triangular wave signal and the rising edge of the reset signal is equal to or smaller than the half value T/2 of the reference period T of the triangular wave signal is assumed similarly to the case shown in FIGS. 7A, 7B, and 7C, wherein FIG. 10A shows the modulated signal in the case of resetting the triangular wave signal in sync with the rising edge of the reset signal rst, and FIG. 10B shows the drive signal COM in the same case. In this comparative example, the duty ratio (on-duty) of the modulated signal increases in the vicinity of the rising edge of the reset signal, and as a result, the drive signal COM becomes temporarily greater than the drive waveform signal WCOM. Such mismatch in the drive signal COM remains as, for example, the vibration inside the nozzle, and might cause the meniscus to be unstable resulting in a failure in emitting a jet of a liquid.

According to the liquid jet apparatus of the present embodiment, since there is adopted the configuration in which the drive waveform generator 25 generates the drive waveform signal WCOM forming a basis for driving the actuators 22, the modulator 26 executes the pulse modulation on the drive waveform signal WCOM, the pair of switching elements of the digital power amplifier 28 push-pull coupled with each other executes the power amplification on the modulated signal on which the pulse modulation is thus executed, and the modulation period adjustment circuit 27 adjusts the modulation period of the pulse modulation of the modulator 26 in accordance with the reset signal rst forming a basis of the timing for driving the actuators 22 when the low pass filter 29 smoothes the amplified digital signal thus power-amplified and outputs the smoothed amplified digital signal towards the actuators 22, it becomes possible to assure the duty ratio of the modulated signal conforming to the drive waveform signal WCOM to output the accurate drive signal COM by adjusting the modulation period in accordance with the phase difference ΔT between the reset signal rst and the modulation period.

Further, in the case in which the pulse modulation by the modulator 26 is the pulse width modulation, since the modulation period adjustment circuit 27 is arranged to have the configuration of detecting the phase difference ΔT between the triangular wave signal of the modulator 26 and the reset signal rst and adjusting the modulation period of the pulse modulation in accordance with the phase difference ΔT, it becomes possible to assure the duty ratio of the modulated signal conforming to the drive waveform signal WCOM to output the accurate drive signal COM.

Further, since there is adopted the configuration of setting the period of the triangular wave signal subsequent to the reset signal rst to be the summed value of the predetermined reference period T and the phase difference ΔT in the case in which the phase difference ΔT between the triangular wave signal of the modulator 26 and the reset signal rst is equal to or smaller than a half of the period of the triangular wave signal, it becomes possible to assure the duty ratio of the modulated signal conforming to the drive waveform signal WCOM.

Further, since there is adopted the configuration of setting the period of the triangular wave signal subsequent to the reset signal rst to be the phase difference ΔT in the case in which the phase difference ΔT between the triangular wave signal of the modulator 26 and the reset signal rst is greater than a half of the period of the triangular wave signal, it becomes possible to assure the duty ratio of the modulated signal conforming to the drive waveform signal.

It should be noted that although in each of the embodiments described above only the case in which the liquid jet apparatus of the invention is applied to the line head-type printing apparatus is described in detail, the liquid jet apparatus of the invention can also be applied to multi-pass printing apparatuses in a similar manner.

Further, the liquid jet apparatus of the invention can also be embodied as a liquid jet apparatus for emitting a jet of a liquid (including a liquid like member dispersing particles of functional materials, and a fluid such as a gel besides liquids) other than the ink, or a fluid (e.g., a solid substance capable of flowing as a fluid and being emitted as a jet) other than liquids. The liquid jet device can be, for example, a liquid jet apparatus for emitting a jet of a liquid including a material such as an electrode material or a color material used for manufacturing a liquid crystal display, an electroluminescence (EL) display, a plane emission display, or a color filter in a form of a dispersion or a solution, a liquid jet apparatus for emitting a jet of a living organic material used for manufacturing a biochip, or a liquid jet apparatus used as a precision pipette for emitting a jet of a liquid to be a sample. Further, the liquid jet apparatus can be a liquid jet apparatus for emitting a jet of lubricating oil to a precision machine such as a timepiece or a camera in a pinpoint manner, a liquid jet apparatus for emitting on a substrate a jet of a liquid of transparent resin such as ultraviolet curing resin for forming a fine hemispherical lens (optical lens) used for an optical communication device, a liquid jet apparatus for emitting a jet of an etching liquid of an acid or an alkali for etching a substrate or the like, a fluid jet apparatus for emitting a gel jet, or a fluid jet recording apparatus for emitting a jet of a solid substance including fine particles such as a toner as an example. Further, the invention can be applied to either one of these jet apparatuses.

What is claimed is:

1. A liquid jet apparatus comprising:

a drive waveform generator adapted to generate a drive waveform signal;

a modulator adapted to execute pulse modulation on the drive waveform signal;

a digital power amplifier adapted to power-amplify the modulated signal, on which the pulse modulation is executed by the modulator, with a pair of switching elements push-pull coupled with each other;

a low pass filter adapted to smooth the amplified digital signal obtained by the power-amplification of the digital power amplifier; and a modulation period adjustment circuit adapted to adjust a modulation period of the pulse modulation of the modulator in accordance with a reset signal forming a basis of timing for driving an actuator.

2. The liquid jet apparatus according to claim 1, wherein in the case in which the pulse modulation by the modulator is a pulse width modulation, the modulation period adjustment circuit detects a phase difference between a triangular wave signal of the modulator and the reset signal, and adjusts the modulation period of the pulse modulation in accordance with the phase difference.

3. The liquid jet apparatus according to claim 2, wherein in the case in which the phase difference between the triangular wave signal of the modulator and the reset signal is equal to or smaller than a half of the period of the triangular wave signal, the modulation period adjustment circuit sets the period of the triangular wave signal subsequent to the reset signal to be a summed value of a predetermined reference period and the phase difference.

4. The liquid jet apparatus according to claim 2, wherein in the case in which the phase difference between the triangular wave signal of the modulator and the reset signal is greater than a half of the period of the triangular wave signal, the modulation period adjustment circuit sets the period of the triangular wave signal subsequent to the reset signal to be the phase difference.

5. A driving method for a liquid jet apparatus, comprising:

generating a drive waveform signal forming a basis for driving an actuator for ejecting a liquid jet;

executing a pulse modulation with a modulator on the drive waveform signal;

power-amplifying the modulated signal on which the pulse modulation is executed with a pair of switching elements of a digital power amplifier push-pull coupled with each other;

detecting, when smoothing the amplified digital signal thus power-amplified with a low pass filter and outputting the amplified digital signal thus smoothed towards the actuator, a phase difference between a triangular wave signal of the modulator and a reset signal in the case in which the pulse modulation by the modulator is a pulse width modulation;

setting, in the case in which the phase difference between the triangular wave signal of the modulator and the reset signal is equal to or smaller than a half of the period of the triangular wave signal, the period of the triangular wave signal subsequent to the reset signal to be a summed value of a predetermined reference period and the phase difference; and setting, in the case in which the phase difference is greater than a half of the period of the triangular wave signal, the period of the triangular wave signal subsequent to the reset signal to be the phase difference.

6. The liquid jet apparatus according to claim 3, wherein in the case in which the phase difference between the triangular wave signal of the modulator and the reset signal is greater than a half of the period of the triangular wave signal, the modulation period adjustment circuit sets the period of the triangular wave signal subsequent to the reset signal to be the phase difference.

* * * * *